US007637724B2

(12) United States Patent
Cygnor

(10) Patent No.: US 7,637,724 B2
(45) Date of Patent: Dec. 29, 2009

(54) VARIABLE DISPLACEMENT VANE PUMP WITH PRESSURE BALANCED VANE

(75) Inventor: John Edward Cygnor, Winnebago, IL (US)

(73) Assignee: Hamilton Sundstrand Corporation, Rockford, IL (US)

( * ) Notice: Subject to any disclaimer, the term of this patent is extended or adjusted under 35 U.S.C. 154(b) by 1077 days.

(21) Appl. No.: 10/922,293

(22) Filed: Aug. 19, 2004

(65) Prior Publication Data

US 2006/0039816 A1 Feb. 23, 2006

(51) Int. Cl.
*F04C 2/344* (2006.01)

(52) U.S. Cl. ..... 418/30; 418/268

(58) Field of Classification Search ..... 418/24, 418/30, 146, 147, 148, 266, 267, 268
See application file for complete search history.

(56) References Cited

U.S. PATENT DOCUMENTS

| | | | | | |
|---|---|---|---|---|---|
| 3,054,357 | A | * | 9/1962 | McGill | 418/77 |
| 3,102,493 | A | * | 9/1963 | Davin | 418/238 |
| 3,180,271 | A | | 4/1965 | Hartmann | |
| 3,645,652 | A | | 2/1972 | Cygnor | |
| 3,711,227 | A | | 1/1973 | Schmitz | |
| 4,175,393 | A | | 11/1979 | Frank | |
| 4,354,809 | A | * | 10/1982 | Sundberg | 418/268 |
| 4,397,621 | A | | 8/1983 | Pickard et al. | |
| 4,505,654 | A | | 3/1985 | Dean, Jr. et al. | |
| 4,529,361 | A | | 7/1985 | Sundberg | |
| 5,266,018 | A | | 11/1993 | Niemiec | |
| 5,290,155 | A | | 3/1994 | Snow et al. | |
| 5,518,380 | A | * | 5/1996 | Fujii et al. | 418/26 |
| 5,545,014 | A | | 8/1996 | Sundberg et al. | |
| 5,562,432 | A | * | 10/1996 | Semba et al. | 418/26 |
| 5,571,005 | A | | 11/1996 | Stoll et al. | |
| 5,733,109 | A | | 3/1998 | Sundberg | |
| 5,839,889 | A | | 11/1998 | Folsom et al. | |
| 6,099,281 | A | | 8/2000 | Sobel | |
| 6,371,745 | B1 | | 4/2002 | Bassine | |
| 6,398,528 | B1 | | 6/2002 | Hansen et al. | |
| 6,478,559 | B2 | | 11/2002 | Bishop et al. | |
| 6,790,013 | B2 | * | 9/2004 | Hunter et al. | 417/220 |
| 6,877,966 | B2 | * | 4/2005 | Henderson | 418/2 |

FOREIGN PATENT DOCUMENTS

| | | |
|---|---|---|
| EP | 0 057 309 | 8/1982 |

* cited by examiner

*Primary Examiner*—Hoang M Nguyen
(74) *Attorney, Agent, or Firm*—Carlson, Gaskey & Olds

(57) ABSTRACT

A radially pressure balanced vane pump includes a housing that defines an inlet port and a discharge port. A cam block disposed within the housing defines a continuous inner surface. A plurality of vanes are supported within rotor slots and rotated above a shaft. Each vane includes a vane tip having a radius with a centerline offset from the centerline of the vane. A pressure biasing the vane into contact with the cam block is distributed over the vane tip radius. Further, the vanes are biased into contact with the inner surface of the cam block by communication of discharge pressure under the vane. The vane tip radius along with the pressure balance between under vane and under vane discharge pressure provide for the use of low cost and easily fabricated ductile steels.

16 Claims, 10 Drawing Sheets

VARIABLE DISPLACEMENT VANE PUMP WITH PRESSURE BALANCED VANE

BACKGROUND OF THE INVENTION

This invention generally relates to a vane pump, and specifically to a vane pump employing radially pressured balanced vanes with improved durability features.

Vane pumps are commonly single acting or double acting and may be fixed or variable displacement. The invention is applicable to all types of vane pumps.

A typical fixed displacement double acting vane pump includes a plurality of vanes supported within a rotor. A shaft supported concentrically within a cam block rotates the rotor. The vanes are driven outward from the rotor into contact with an inner surface of the cam block. Each vane sweeps through two inlet regions to draw in a quantity of fluid. The quantity of fluid is trapped within a chamber defined between the vanes. The variable radius of the inner surface of the cam block with respect to the concentric shaft provides for a cyclical change in volume defined between the vanes. The change in volume generates a desired fluid flow rate. The fluid is then discharged through two discharge regions at an elevated pressure as determined by the downstream resistance.

Following each inlet arc is a pump arc for transferring the fluid from the inlet region to the discharge region and to provide a discharge to inlet seal. Following each discharge region is a seal arc that completes the discharge to inlet seal. In conventional vane pumps it is known to provide a means for balancing pressures under the vanes and over the vanes in the inlet and discharge regions to maintain contact with the inner surface of the cam block. As the rotor turns the vanes are moved through a low-pressure inlet arc of the pressure chamber, a pump arc where the leading surface of the vane is exposed to increasing pressure while a trailing surface is exposed to low pressure from the inlet. The vane further rotates through a discharge arc where pressures are essentially the same on each of the leading and trailing surfaces.

The vane also rotates through a pump arc where high pressure is exerted on the leading surface of the vane and low pressure is exerted on the trailing surface and a seal arc where low pressure is exerted on the leading surface of the vane and high pressure is exerted on the trailing surface of the vane. In the inlet arc inlet pressure is provided under the vanes, therefore in the inlet arc the vanes are radially pressure balanced. In the discharge arc discharge pressure is provided under the vanes, therefore the vanes are also radially pressure balanced in the discharge arc.

In the pump arc and the seal arc to maintain a seal between the vane tip and the cam inner surface discharge pressure is provided under the vanes. Above the vane one half of the vane is subject to discharge pressure. The vane, therefore, is radially over pressure balanced by a factor of two. This excess radial pressure load results in high adhesive wear stresses between the vane tips and the inner surface of the cam block resulting in damage to the vane and to the cam surface resulting in reduced displacement capacity.

Typically, the vanes and the cam block are fabricated from hard and brittle material in order to compensate for wear and frictional forces encountered between the vanes and the cam block. In some rotary vane pump applications, compressive stresses caused by unequal pressures on the leading and trailing surfaces, are far greater than capabilities of known steels. For this reason, the vane and cam block are typically fabricated from extremely hard materials such as Tungsten Carbide. Such hard materials are expensive, brittle and difficult to machine.

Accordingly, it is desirable to develop a balanced vane pump using ductile low cost materials to reduce costs, provide increased durability and simplify fabrication.

SUMMARY OF INVENTION

The present invention is a radially pressure balanced vane pump including vanes of an inverted "L" design having a vane tip radius offset from the leading of the vane to bias the vane against the inner surface of a cam block.

The vane pump of the present invention includes a housing defining an inlet port and a discharge port. A cam block disposed within the housing defines a continuous inner surface. A plurality of vanes are supported within rotor slots and rotated about a shaft in the cam block. Each of the vanes are supported for radial movement within the rotor and include a vane tip having a radius centerline that is offset from the leading face of the vane leg. The offset centerline of the vane tip radius provides a positive vane contact with the inner surface of the cam block without over loading the contact point.

Each of the vanes is biased into contact with the inner surface of the cam block by the communication of selected pressures under the vane. The specific configuration of a vane according to this invention reduces the overall pressure between each vane and the inner surface of the cam block allowing the use of ductile steels in place of brittle and expensive harder steels. The use of ductile steels provides a gradual or predictable failure mode instead of the unpredictable and sudden failure modes characteristic of harder materials Accordingly, the present invention provides a balanced vane pump including ductile low cost materials that reduce costs, provide for increased durability and simplifies fabrication

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
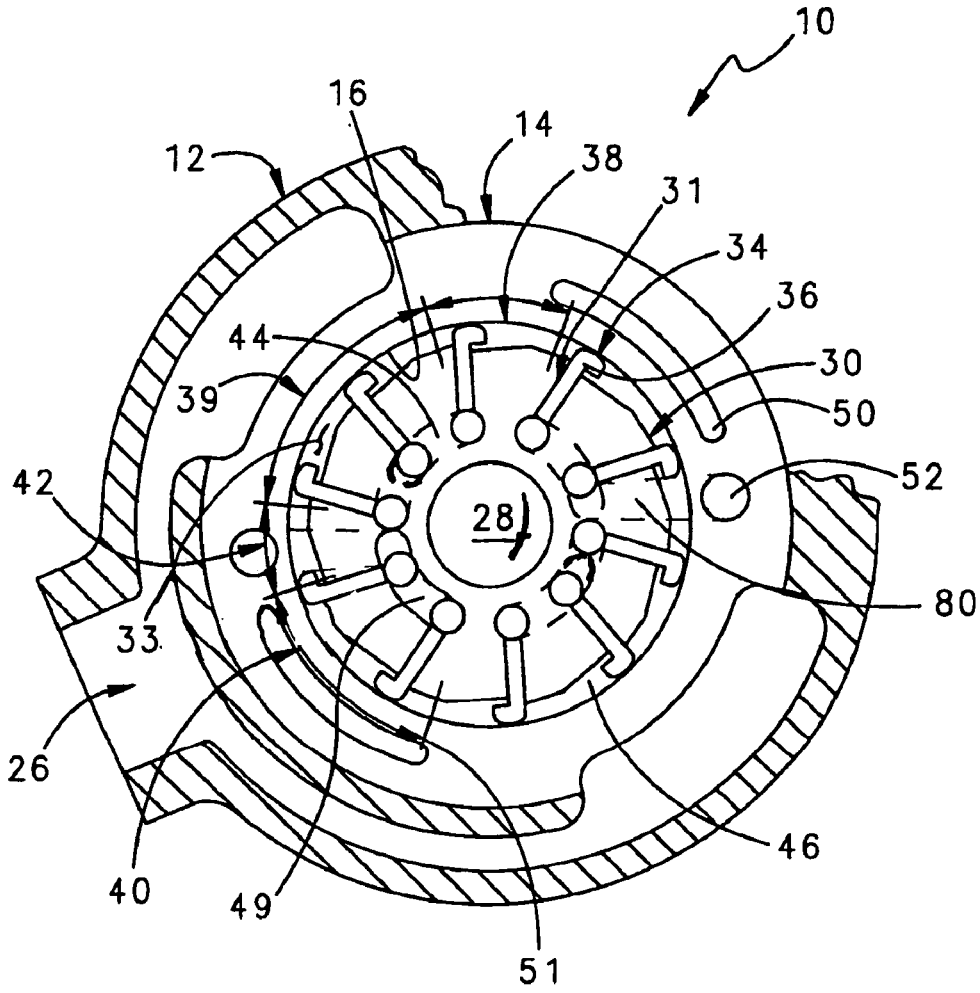
FIG. 1 is a cross-sectional view of a vane pump perpendicular to a drive centerline.
Figure 7:
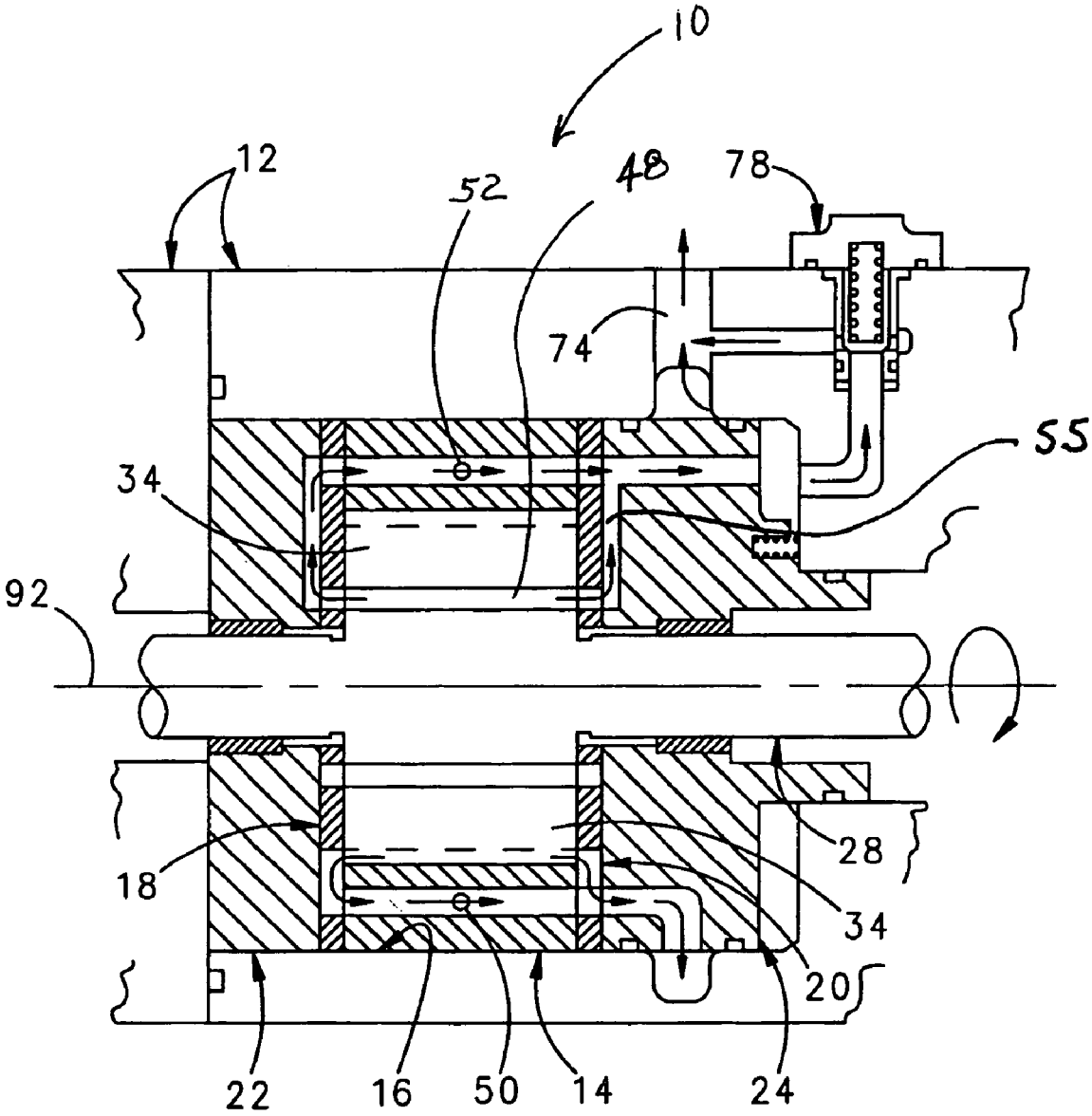
FIG. 7 is a cross-sectional view of the vane pump parallel to the drive centerline.

Referring to FIG. 1, a radially pressure balanced vane pump assembly 10 includes a housing 12 that defines an inlet port 26 and a discharge port 74 (FIG. 7). The housing 12 supports a cam block 14. The cam block 14 includes a continuous inner surface 16. A shaft 28 is supported concentrically within the cam block 14. The shaft 28 supports a rotor 30 that includes a plurality of radially extending slots 31. Within each of the slots 31 is a rotor vane 34. Each rotor vane 34 includes a vane tip 36. Each vane tip 36 abuts the inner surface 16 of the cam block 14.

Shaft 28 rotates within the cam block 14 to move each of the vanes 34 about the circumference of the inner surface 16 of the cam block 14. The cam contour of the inner surface 16 creates radial movement of each of the vanes 34. The vanes 34 move into and out of the slots 31 defined by the rotor 30. Each vane 34 moves sequentially, twice each revolution, through an inlet arc 39, a pump arc 38, a discharge arc 40 and a seal arc 42. Fluid entering the inlet port 26 is drawn into a volume 33 defined between the vanes 34.

The volume 33 is defined between adjacent vanes 34. The volume 33 begins at an initial size that is progressively increased in the inlet arc 39 as the rotor 30 rotates within the cam block 14. In the pump arc 38 the vane 34 extends a constant amount from the rotor 30. As the vane 34 is rotated through the discharge arc 40 the distance in which the vane 34 extends from the rotor 30 is gradually decreased. The decrease in extension of the vanes 34 causes a proportional decrease in the volume 33 and fluid is then discharged from the rotary vane pump 10 during movement of the vanes through the discharge arc 40. The discharge pressure is dependent upon the resistance of the downstream system.

Figure 2:
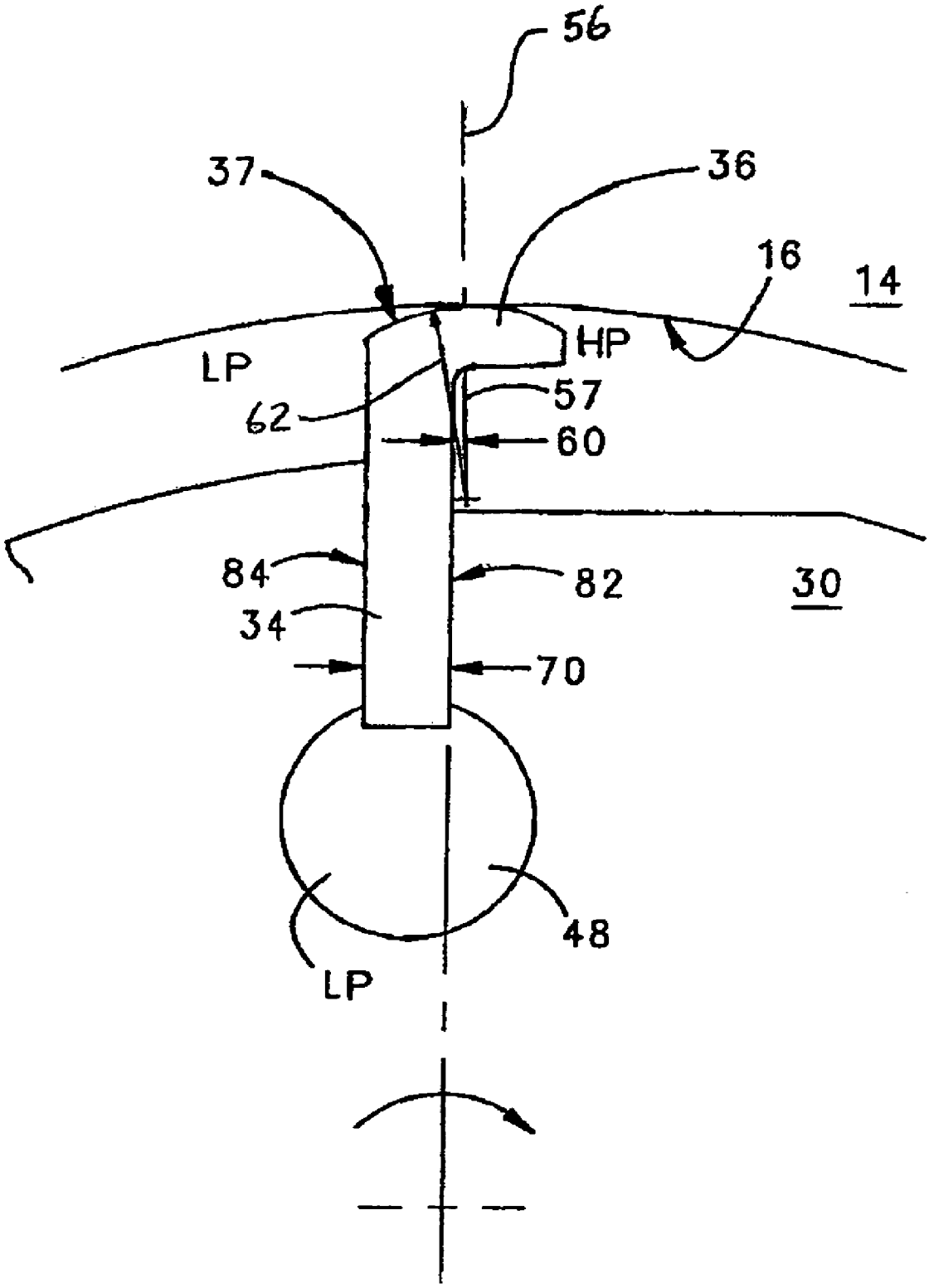
FIG. 2 is a schematic view of a vane according to this invention.

Referring to FIG. 2, each vane 34 includes a tip portion 36. In rotary vane pumps it is desirable to have a positive pressure load toward the inner surface 16 to maintain a leak tight seal therebetween. The tip portion 36 forms an inverted L and includes a radius 62. The tip portion 36 includes a contact surface 37 abutting the interior surface 16 of the cam block 14. It is desirable to maintain contact between the contact surface 37 of the vane tip 36 and the inner surface 16 of the cam block 14 to provide efficient and consistent output of the rotary vane pump 10.

Contact pressure between the inner surface 16 of the cam block 14 and the vane 34 is balanced such that excessive pressure is not exerted by the vane 34 on the inner surface 16 of the cam block. Contact pressure between the vane tip 36 and the inner surface of the cam block 14 is exerted over the curved contact surface 37 of the vane tip 36. The large curved contact surface 37 distributes balance pressure exerted against the inner surface 16 of the cam block 14 to reduce compressive stress that cause adhesive wear on the vane tip 36.

In addition to the large curved contact surface 37, a centerline 56 of the vane tip 36 is offset a distance 60 from a leading surface 82 of the vane 34 to provide a minimum positive contact force holding the vane 34 against the inner surface 16 of the cam block 14. The centerline 56 of the vane tip 36 is offset from a leading surface 82 of the vane 34. The offset centerline 56 of the vane tip 36 provides a small positive imbalanced force that maintains the vane tip 36 against the inner surface 16 of the cam block 14. The positive pressure between the inner surface 16 of the cam block 14 and the curved surface 37 creates a seal between the vane tip 36 and the inner surface 16 of the cam block 14. The contact pressures are distributed over the large curved surface 37 to reduce compressive stresses that cause adhesive wear.

The inverted L vane 34 incorporates the increased radius tip 36 to distribute pressure forces over a larger area. The pressure loading force pushing the vane 34 against the inner surface 16 of the cam block 14 in the pump arc 38 is a product of the offset 60 of the tip radius 62 of the vane 34, the pump pressure differential and the length of the vane 34. This resulting pressure loading force is less than pressure loading forces present in prior art vane pump designs.

Furthermore, the extended length of the vane tip 36 of the inverted L vane design deploys a large vane tip radius 62. The combination of the reduced compressive stresses between the vane 34 and the inner surface 16 of the cam block 14 combine to lower the limits required of the material. The configuration allows the use of more ductile steels instead of the Tungsten Carbide. High-alloyed steels are employed for fabrication of the vanes 34, and are capable of operating in conditions previously requiring Tungsten Carbide. The use of alloyed steel material is provided through the configuration of a vane 34 according to this invention. The width 70 of the vane 34 is less than the width of the vane tip 36. The vane tip 36 is of increased length to allow for a greater radius 62 that further reduces compressive forces against the inner surface 16 of the cam block 14.

Each vane 34 is mounted within slots 31 of the rotor 30. Under each vane 34 is an undervane port 48. This undervane port 48 is in communication with either inlet or discharge pressures to bias the vane 34 against the inner surface 16 of the cam block 14.

Figure 3:
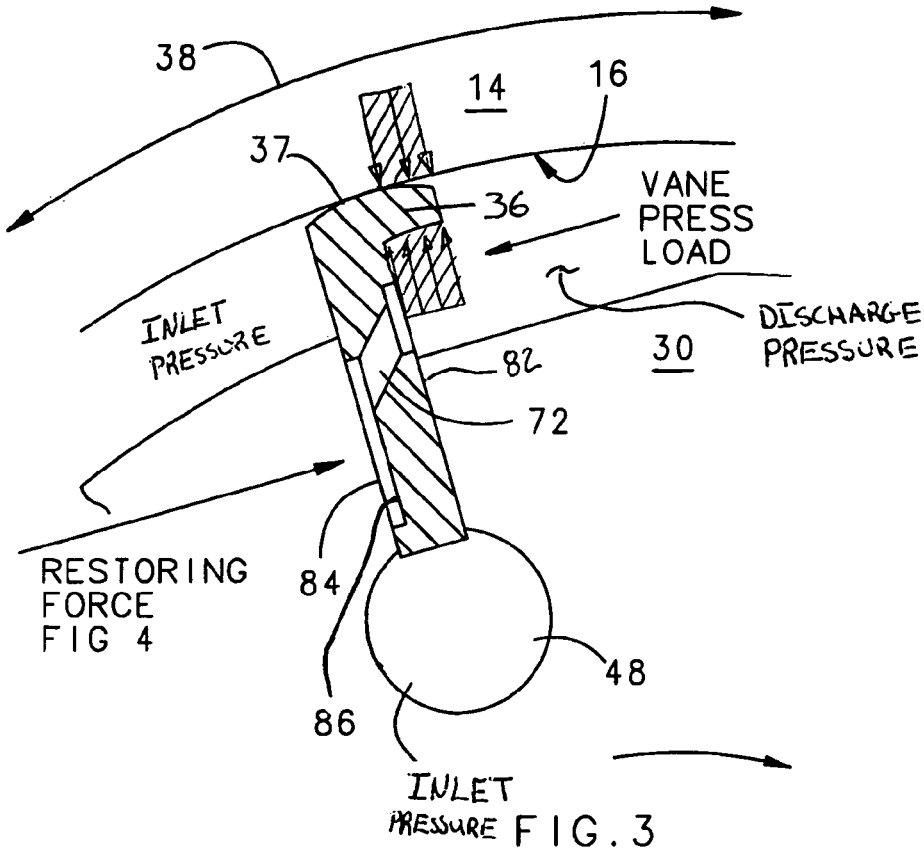
FIG. 3 is a schematic view of the vane within a pump arc.

Referring to FIG. 3, as the vane 34 moves through the pump arc 38, high pressure exerted on the leading surface 82 of the vane 34 acts under and over the vane tip 36 and through the off-set 60 of the tip radius 62 to provide the minimum radial pressure on the vane 34 that ensures and provides desired sealing pressures against the inner surface 16 of the cam block 14. In the pump arc 38 the undervane port 48 is communicated to inlet pressure by the undervane inlet channel 44. Low pressure is thereby applied to the underside of the vane leg 70 and the trailing portion of the contacting surface 37 of the vane 34 to complete the vane radial pressure balance.

Figure 5:
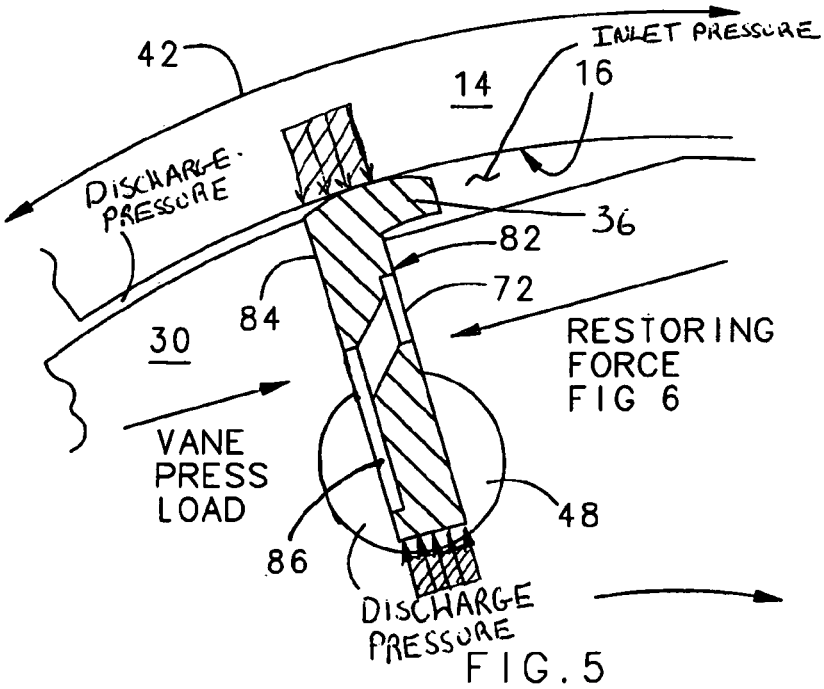
FIG. 5 is a schematic view of the vane within a seal arc.

Referring to FIG. 5, during travel through the seal arc 42, high-pressure fluid exerts a force against the trailing edge surface 84 of the vane 34. Low pressure (fluid pressure from the inlet) exerts a force against the leading surface 82 of the vane 34. Discharge pressure acting through the off-set 60 of the tip radius 62 of the vane 34 causes a negative pressure load that creates an imbalance on the vane 34. The negative discharge pressure in the undervane area counteracts imbalance forces on the vane 34. Discharge pressures exert forces on the trailing edge 84 that tend to drive the vane 34 away from the inner surface 16 of the cam block 14. Movement away from the inner surface 16 would result in undesirable chatter and leakage by the vane 16. Therefore, an undervane pressure higher than discharge is provided to each of the vanes 34. The undervane port 48 communicating with the undervane discharge channel 49 provides the biasing force on the vane 34 that causes abutment against the inner surface 16 of the cam block 14. The overvane displacement provides a portion of the total displacement of the rotary vane pump 10. The undervane discharge flow is maintained separate from the overvane discharge flow. To provide the required counteracting pressure load a flow regulating valve 78 (FIG. 7) is placed between the undervane 49 and overvane 51 discharge channels. The flow-regulating valve 78 maintains pressures within the undervane channels at a desired level that is some proportion of the maximum pressure rise through the rotary vane pump 10. This desired pressure level is determined to provide positive pressure of the vane 34 against the inner surface 16 of the cam block 14 in the seal arc 42.

Figure 4:
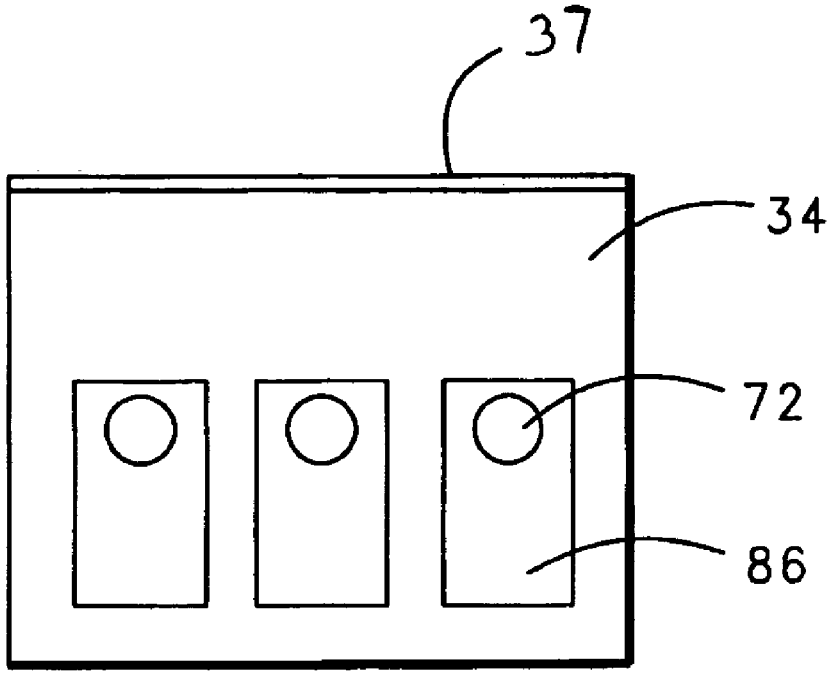
FIG. 4 is a plan view of a trailing surface of the vane.
Figure 6:
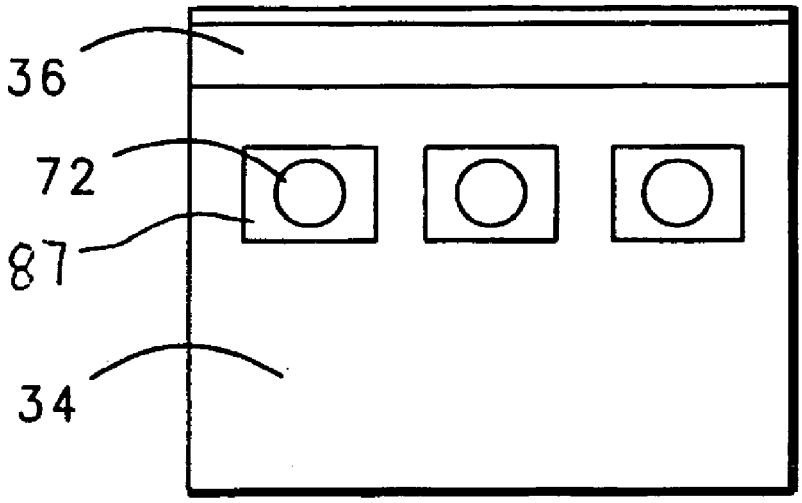
FIG. 6 is a plan view of a leading surface of the vane.

Referring also to FIGS. 4 and 6, the vent 72 communicates discharge pressure through the vane 34 to provide lateral force balance to reduce the friction-generated loads between the vanes 34 and the rotor slots 31. Reducing friction generated loads between the rotor slots 31 and the vanes 34 allow the vane 34 to freely float within the vane slots 31 in order to allow the pressure balances to properly be applied to the vane 34 and against the inner surface 16 of the cam block 14. Each opening 72 includes a channel portion 86 disposed on the trailing surface 84 of the vane 34 and a channel portion 87 disposed on the leading surface 82 of the vane 34.

Referring to FIG. 7, the rotary vane pump 10 is shown in cross section parallel to the shaft centerline 92. The vanes 34 are biased against the inner surface 16 of the cam block 14 in the seal arc 42 and discharge arc 40 by high-pressure fluid communicated to with an under vane discharge channel 48. Fluid is also discharged through an over vane discharge channel 50. Discharge flow above and below the vane 34 is communicated from the housing through discharge ports 74. The discharge port-regulating valve 78 regulates the pressure differential between discharge fluid within the undervane discharge channel 52 and the overvane discharge channel 50. Control of the difference between pressures within the under vane and over vane discharge channels 52, 50 balances each of the vanes 34 during rotation in the discharge arc 40 and the seal arc 42.

Figure 8:
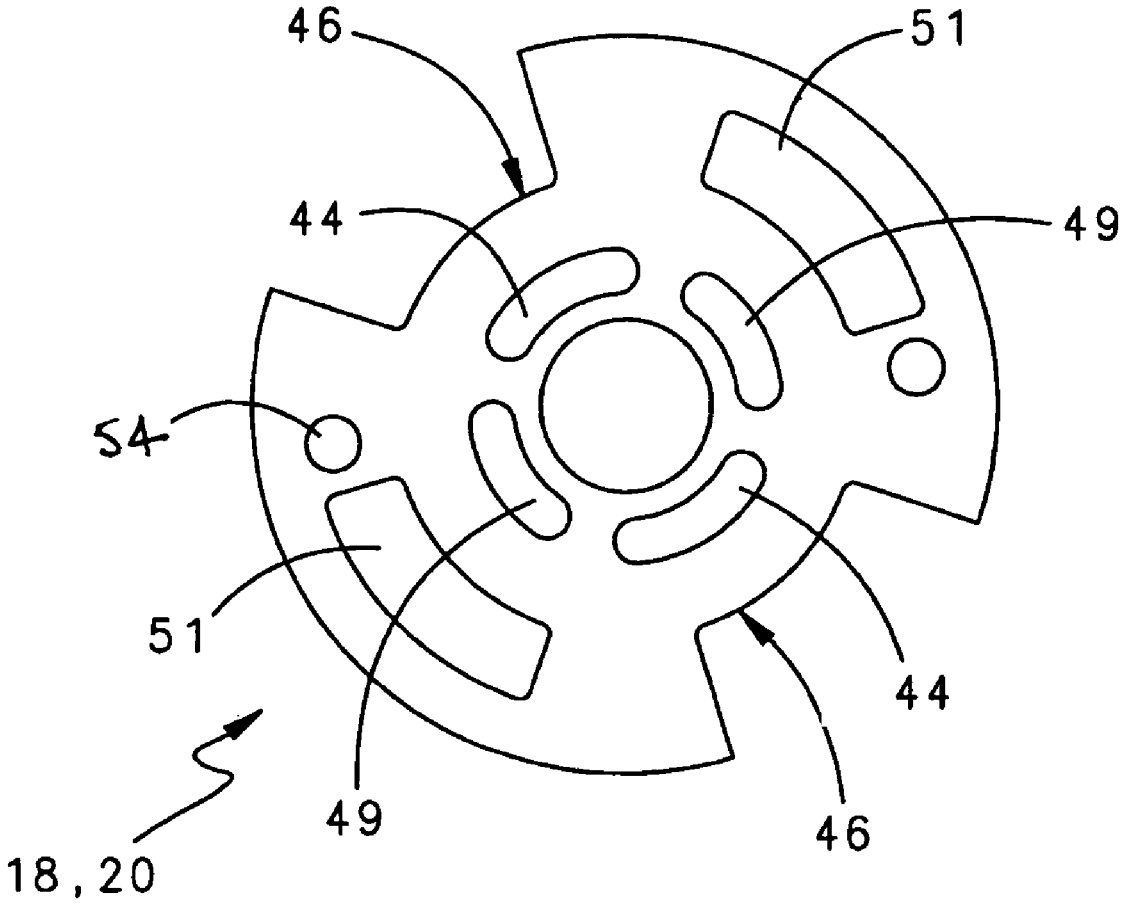
FIG. 8 is a plan view of a port plate.

Referring to FIG. 8, the vanes 34 rotate adjacent port plates 18 and 20. The port plates 18, 20 include ports 51 that comprise a portion of the over vane discharge channel 50 and ports 49 that comprise a portion of the under vane discharge channel. Further, each port plate 18, 20 includes ports 46 defining a portion of an over vane inlet channel, and a port 44 defining a portion of an under vane inlet channel.

Figure 9:
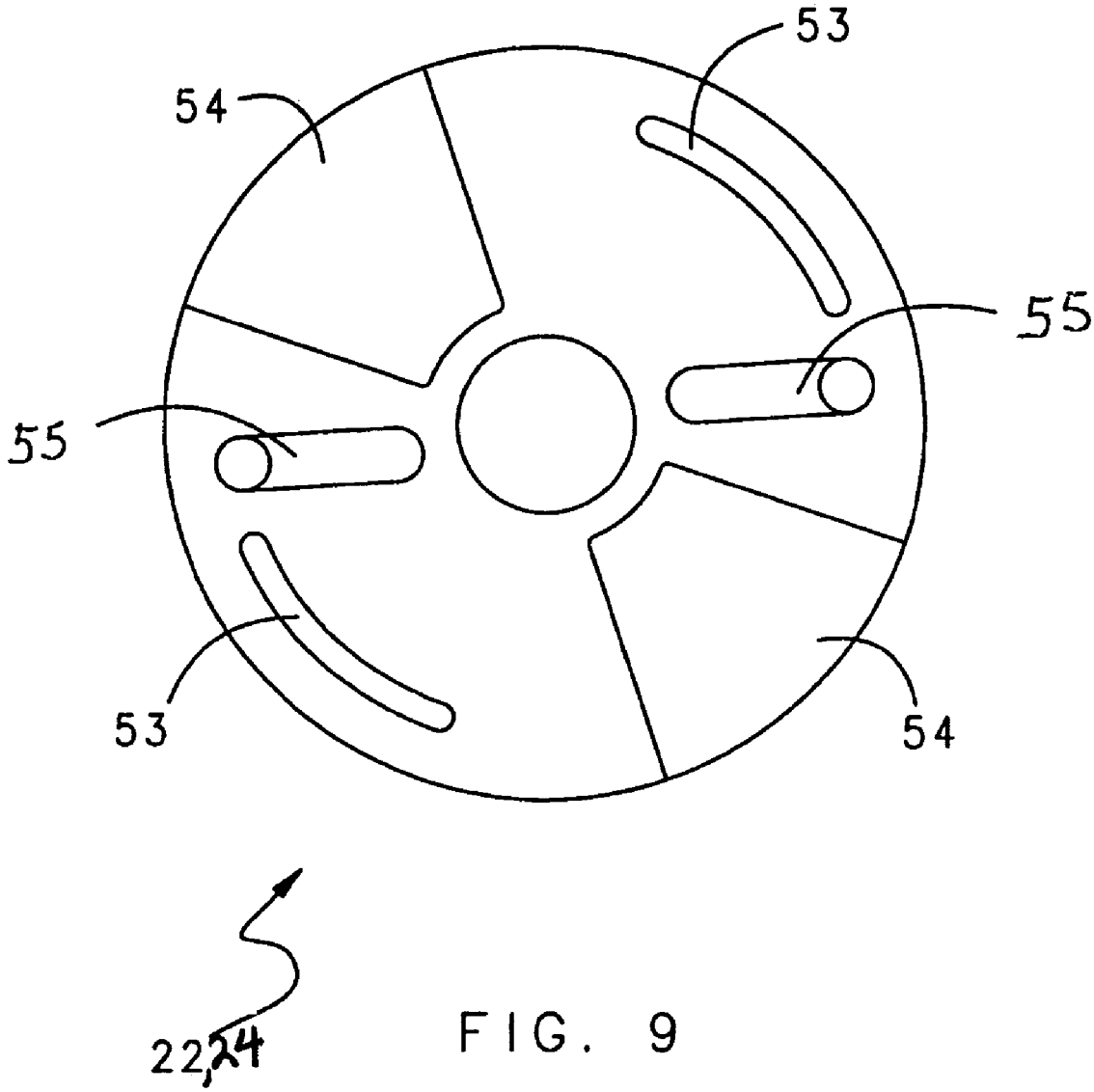
FIG. 9 is a plane view of an end cap assembly.

Referring to FIG. 9, end cap assemblies 22, 24 include additional ports that define portions of the under vane and over vane discharge channels 52, 50. An inlet channel 54 defines a portion of the under vane and over vane inlets. Channel 55 defines a portion of the under vane discharge channel 52, and channels 53 defines a portion of the over vane discharge channel 50. The end caps 22, 24 correspond with the port plates 18, 20 to define inlet channels and discharge channels 52, 50. The specific configuration of the various ports and channels that form the inlet and discharge channels are application specific, and a worker skilled in the art, with the benefit of this disclosure would understand how to size and configure specific passage for a specific application.

Figure 10:
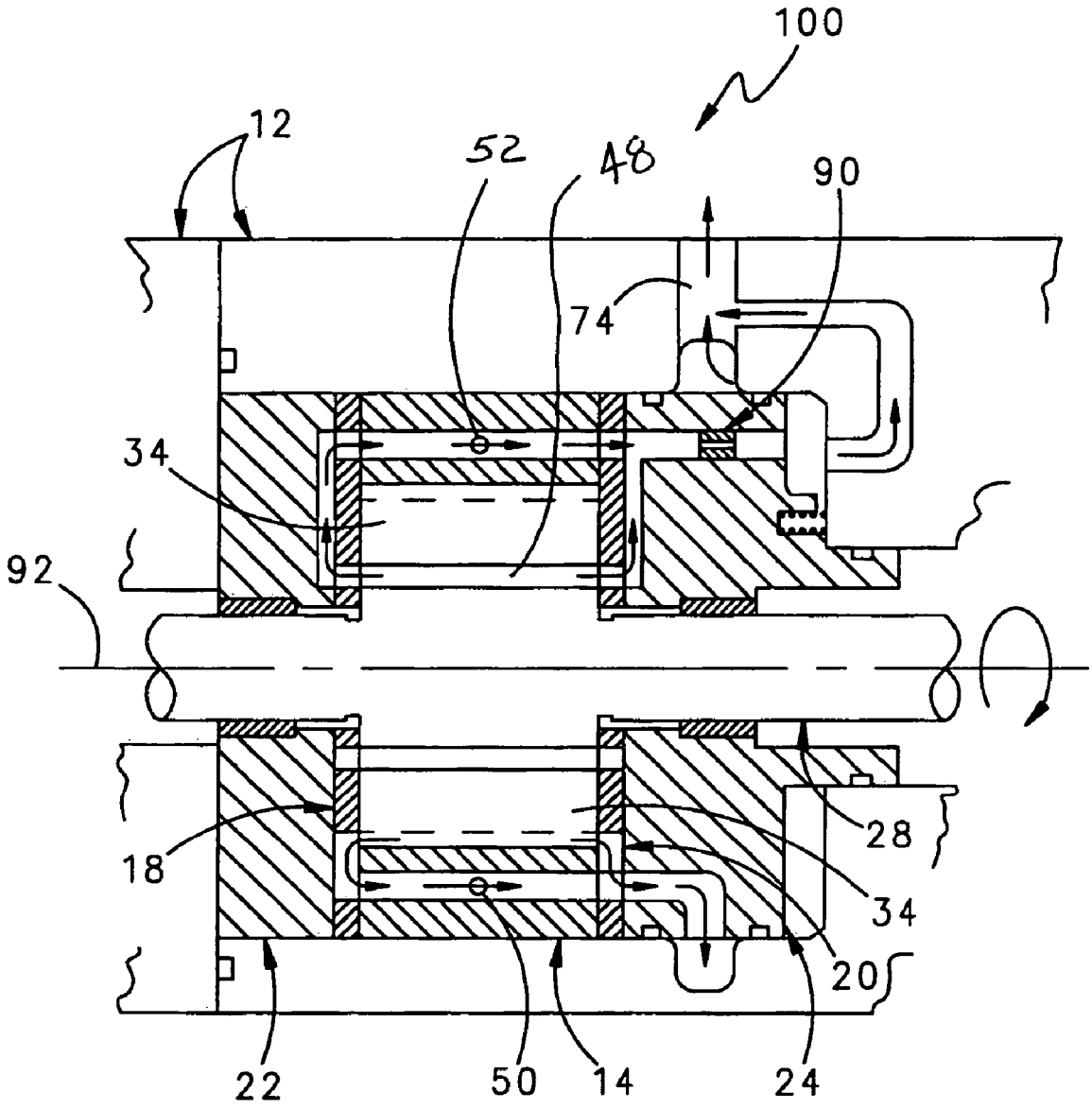
FIG. 10 is a cross-sectional view of another rotary vane pump according to this invention.

Referring to FIG. 10, another rotary vane pump 100 according to this invention includes a fixed orifice 90 that controls the pressure differential between discharge pressures within the under vane discharge channels 52 and the over vane channels 50. The orifice 90 provides pressure differential between pressures within the under vane channel 52 and the over vane channel 50. The use of the fixed orifice 90 is favorable for applications having a relatively narrow range of drive speed and pressure range requirements. Contrary to the rotary pump assembly 10 shown in FIG. 7 including a pressure-regulating valve 78 favorable for applications having a relatively wide range of drive speeds and pressure output requirements.

Figure 11:
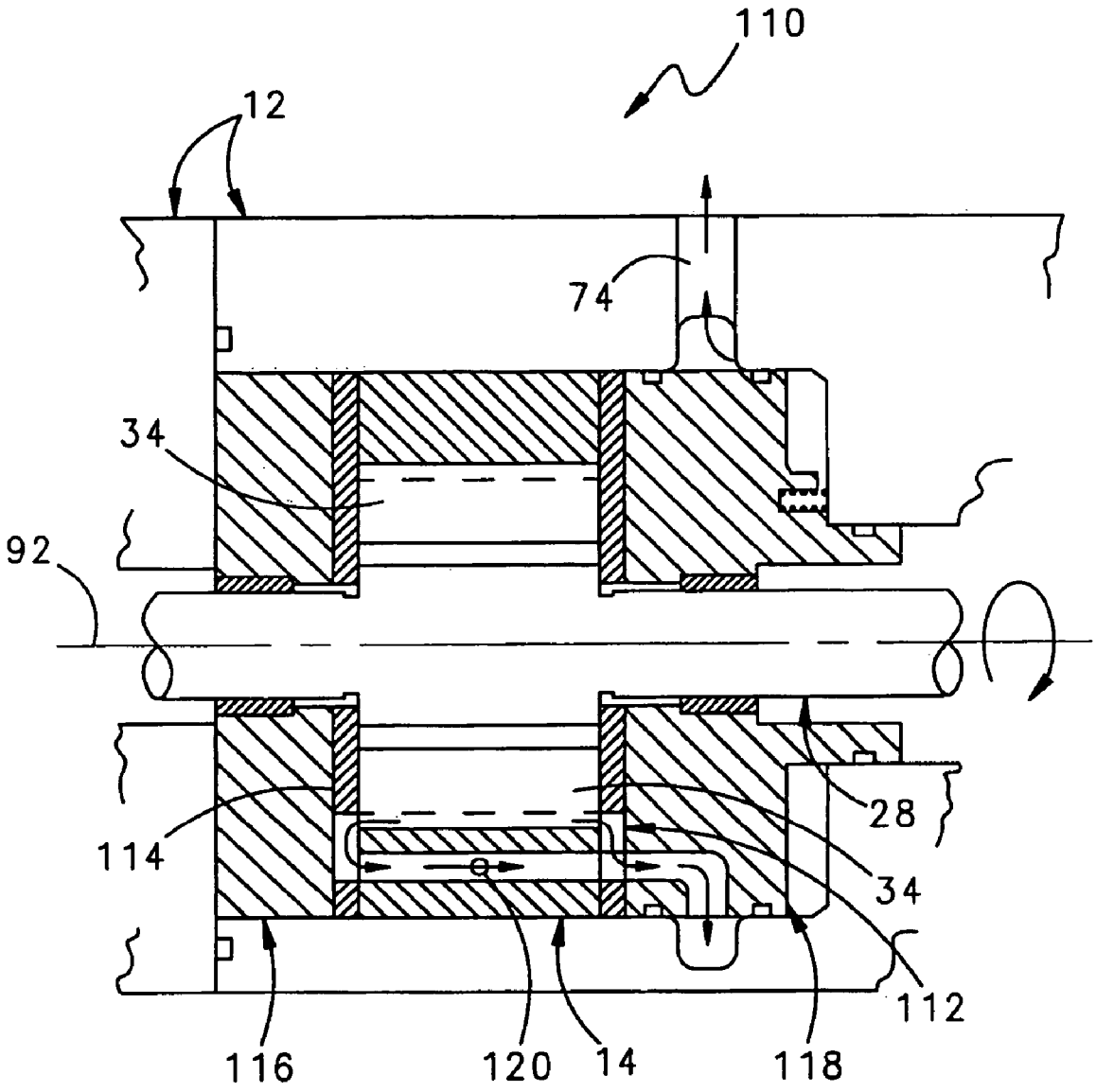
FIG. 11 is a cross-sectional view of yet another vane pump according to this invention parallel to the drive centerline.

Referring to FIG. 11, another rotary pump assembly 110 is shown and includes vanes 34 supported within slots 31 of a rotor 30. In this rotary pump assembly 110 centripetal forces are the dominant force loading the vanes 34 against the inner surface 16 of the cam block 14. Therefore, discharge configuration is simplified.

Figure 12:
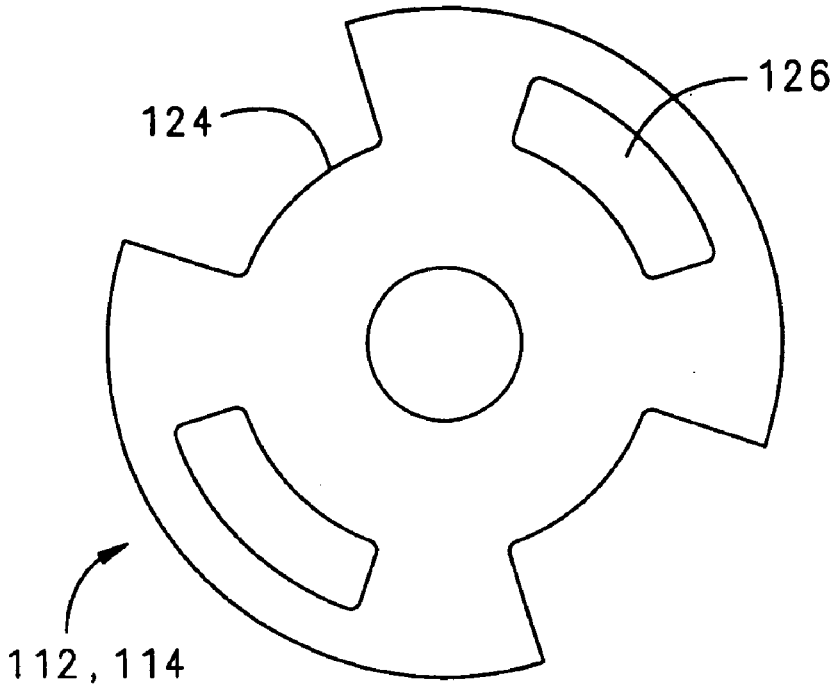
FIG. 12 is a plan view of a port plate for the rotary vane pump shown in FIG. 11.
Figure 13:
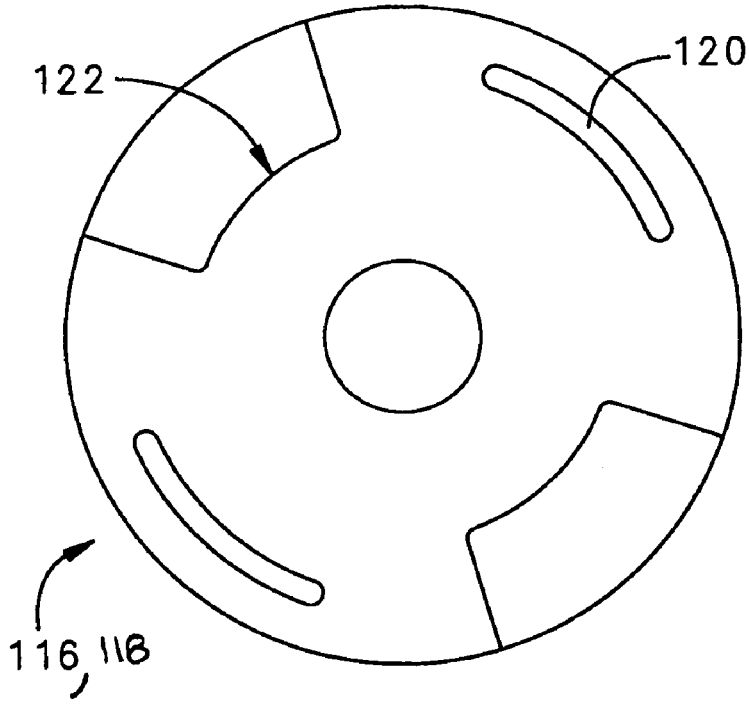
FIG. 13 is a plan view of an end cap for the rotary vane pump shown in FIG. 11.

Referring to FIGS. 12 and 13, the port plates 114, 112, define inlet ports 124 that comprise a portion of an inlet channel 122 in cooperation with the end caps 116, 118. The end cap 118 defines the inlet channel 122 and the discharge channel 120. The simplified configuration of the port plates 112, 114 and end caps 116, 118 are possible due to the vane configuration 34 providing for improved wear and durability characteristics.

A rotary vane pump assembly designed with the benefit of the disclosures of this invention provides vanes 34 having increased durability and pressure loading characteristics to provide for the use of ductile steels that in turn reduces material costs, simplifies fabrication and provides favorable durability characteristics.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A radially pressured balanced vane pump assembly comprising:

a housing defining an inlet port and a discharge port;

a cam block defining a continuous inner surface having a first radius;

a rotor supported on a shaft for rotation within said cam block; and a plurality of "L" shaped vanes supported for radial movement within said rotor, each of said "L" shaped vanes comprising a vane tip having a second radius different than the first radius centered on a centerline offset relative to a leading surface, of a vane leg of said vane to create a controlled unbalanced force to bias each of said plurality of vanes into contact with said inner surface of said cam block.

2. The assembly recited in claim 1, wherein each of said plurality of vanes comprises alloyed steel.

3. The assembly recited in claim 1, wherein said second radius in sealing contact with said inner surface of said cam block is smaller than said first radius.

4. The assembly recited in claim 1, further comprising a vent disposed within each of said plurality of vanes for communicating pressure between said leading surface of said vane to a trailing surface of said vane.

5. The assembly recited in claim 1, further comprising a port plate defining a portion of an over vane discharge channel and a portion of an under vane discharge channel, and discharge pressure is selectively communicated between said under vane discharge channel and said over vane discharge channel.

6. The assembly recited in claim 5, further comprising a regulating valve for controlling a pressure difference between said over vane and under vane discharge channels.

7. The assembly of claim 5, further comprising a flow orifice for regulating a difference in pressure between said over vane and under vane discharge channels.

8. The assembly recited in claim 5, wherein said housing further comprises first and second end cap assemblies, each of said first and second end cap assemblies comprises a portion of said under vane and over vane discharge channels.

9. A vane pump assembly comprising:

a housing defining an inlet port and a discharge port;

a cam block defining a continuous inner surface;

a rotor supported on a shaft for rotation within said cam block;

a plurality of "L" shaped vanes supported for radial movement within said rotor, wherein each of said plurality of vanes comprises a leading surface and a trailing surface, and a passage through said vane to communicate pressure between said leading surface and said trailing surface;

an undervane discharge channel and an overvane discharge channel; and a valve for regulating pressure communication between said undervane discharge channel and said overvane discharge channel.

10. The assembly recited in claim 9, wherein each of said plurality of vanes comprises a vane tip, said vane tip comprises a centerline offset a predetermined distance in a direction of rotation from said leading surface.

11. The assembly recited in claim 10, wherein said vane tip includes a surface defining a curved surface for contacting said inner surface of said cam block.

12. The assembly recited in claim 9, wherein each of said plurality of vanes comprises alloyed steel.

13. The assembly recited in claim 9, further comprising first and second port plates and first and second end cap assemblies, said port plates and end caps define said undervane and overvane discharge channels, and said regulating orifice is disposed within one of said end cap assemblies.

14. The assembly as recited in claim 1, wherein said centerline of said vane tip is offset relative to said leading surface of said vane leg in a direction of rotation of said vane.

15. A radially pressured balanced vane pump assembly comprising:

a housing defining an inlet port and a discharge port;

a cam block defining a continuous inner surface;

a rotor supported on a shaft for rotation within said cam block, wherein said rotor includes a plurality of radial slots; and a plurality of "L" shaped vanes supported for radial movement within said radial slots of said rotor, each of said "L" shaped vanes including a first opening in a leading surface and a second opening in a trailing surface, and a passage through said vane to communicate pressure between said leading surface and said trailing surface, wherein the second opening on the trailing edge remains within the radial slots during all operation.

16. The assembly as recited in claim 15, wherein said plurality of "L" shaped vanes includes a vane tip having a radius with a centerline offset in a direction of rotation relative to a leading surface of a vane leg of said vane to create a controlled unbalanced force to bias each of said plurality of vanes into contact with said inner surface of said cam block.

* * * * *